United States Patent [19]

Dolengowski

[11] Patent Number: 4,890,568

[45] Date of Patent: Jan. 2, 1990

[54] STEERABLE TAIL BUOY

[75] Inventor: George A. Dolengowski, Bellaire, Tex.

[73] Assignee: Exxon Production Research Company, Houston, Tex.

[21] Appl. No.: 236,107

[22] Filed: Aug. 24, 1988

[51] Int. Cl.[4] ..... B63B 21/00

[52] U.S. Cl. ..... 114/246; 114/253; 114/163

[58] Field of Search ..... 114/162, 163, 242, 244, 114/246, 253

[56] References Cited

U.S. PATENT DOCUMENTS

| | | | |
|---|---|---|---|
| 1,717,286 | 6/1929 | Ward | 114/163 |
| 3,125,980 | 3/1964 | Anderson | 114/235 |
| 3,469,552 | 9/1969 | Patrick | 114/246 |
| 3,560,912 | 2/1971 | Spink et al. | 340/ |
| 3,605,674 | 9/1971 | Weese | 114/235 B |
| 3,710,749 | 1/1973 | Duryea | 114/163 |
| 3,774,570 | 11/1973 | Pearson | 114/235 |
| 3,896,756 | 7/1975 | Pearson et al. | 114/235 B |
| 4,033,278 | 7/1977 | Waters | 114/245 |
| 4,063,213 | 12/1977 | Itria et al. | 340/ |
| 4,087,780 | 5/1978 | Itria et al. | 340/7 R |
| 4,130,078 | 12/1978 | Cholet | 114/244 |
| 4,290,124 | 9/1981 | Cole | 367/18 |
| 4,323,989 | 4/1982 | Huckabee et al. | 367/181 |
| 4,350,111 | 9/1982 | Boyce, II | 114/245 |
| 4,404,664 | 9/1983 | Zachariadis | 367/19 |
| 4,463,701 | 8/1984 | Pickett et al. | 114/245 |
| 4,506,352 | 3/1985 | Brandsaeter et al. | 367/21 |
| 4,574,723 | 3/1986 | Chiles et al. | 114/253 |
| 4,729,333 | 3/1988 | Kirby et al. | 114/244 |
| 4,763,126 | 8/1988 | Jawetz | 441/16 |

FOREIGN PATENT DOCUMENTS 2047406B 9/1983 United Kingdom .

*Primary Examiner*—Sherman D. Basinger
*Assistant Examiner*—Stephen P. Avila
*Attorney, Agent, or Firm*—Sheila M. Luck

[57] ABSTRACT

A remotely controllable tail buoy for use in marine geophysical prospecting operations is disclosed. The tail buoy is attached to the trailing end of one or more seismic streamers towed by the vessel. The tail buoy is provided with rudders that are controlled by a steering mechanism and communication system. The communication system collects and processes radio signals emitted from a radio transmitter located on the towing vessel. The processed signals control the steering mechanism which includes a hydraulic pump for directing fluid into a hydraulic cylinder. The fluid flow rotates the rudders. The tail buoy will travel toward the direction that the rudders are turned and thus avoid hooking or entangling of the tail buoy on other like tail buoys or structures.

15 Claims, 2 Drawing Sheets

STEERABLE TAIL BUOY

FIELD OF THE INVENTION

This invention relates generally to marine towing operations. More specifically, but not by way of limitation, it relates to a steerable tail buoy for use while gathering marine seismic data using one or more seismic streamers.

BACKGROUND OF THE INVENTION

In recent years the search for oil and gas has moved offshore. In order to locate potential offshore oil and gas reservoirs, it has been necessary to develop new devices and techniques for conducting marine geophysical prospecting operations. Due to the hostile environment in which they are conducted, such operations are typically quite difficult and costly to perform.

The primary method for conducting marine geophysical prospecting operations involves the use of towable marine seismic sources and seismic receiver cables. The basic principles of this prospecting method are well known to those skilled in the art. The seismic source(s) introduce seismic signals into the body of water. The signals travel downwardly through the water, across the water-floor interface, and into the subterranean geological formations, and are, to some extent, reflected by the interfaces between adjacent formations. The reflected signals travel upwardly through the geological formations and the body of water to a seismic receiver cable located near the surface of the body of water. The seismic receiver cable typically contains a number of hydrophones spaced along its length which record the reflected signals. Analysis of the signals recorded by the hydrophones can provide valuable information concerning the structure of the subterranean geological formations and possible oil and gas accumulation therein.

Seismic receiver cables, commonly known as "streamers", are usually towed below the water surface. The streamers are preferably of neutral buoyancy and can be balanced by filling them with a liquid having a specific gravity less than 1 to add flotation, or by removing excess liquid or taping lead strips to the outer surfaces of the streamers to reduce flotation. As is well known to those skilled in the art, a properly balanced streamer should maintain approximately the same depth along its entire length while it is being towed. Balancing the streamer is often a difficult process as it is possible for the streamers to be 6 kilometers (3.7 miles) long or more.

The depth of the streamers during tow is usually controlled by winged devices known as "birds" which are attached to the streamers typically every 300 to 500 meters (about 1000 to 1600 feet). The birds are provided with remote depth controls which enable them to maintain the streamer at a uniform running depth or to raise or lower the streamer. A typical bird looks like a torpedo, being about 0.6 meters (2 feet) long, with two short winglike fins. It usually separates into halves, along its length, and is hinged on one side so that it can be opened and clamped onto the cable. One example of a bird is described in U.S. Pat. No. 3,605,674 which issued on Sept. 20, 1971 to Weese.

At the trailing end of the streamer, away from the vessel, a tail buoy is attached to the streamer, typically by a rope. The tail buoy enables the vessel operators to determine and mark the approximate location of the end of the streamer. It also serves as a warning device for other vessel operators to indicate that a streamer is being towed. The tail buoy is usually a catamaran raft provided with tubular floats, lights and radar reflectors. The rope, which may range in length from 30 to 300 meters (about 100 to 1000 feet), allows the tail buoy to float on the surface of the water without raising the trailing end of the streamer.

In recent years, it has become feasible to tow a plurality of streamers, laterally spaced apart, behind a single vessel. As a result, a greater survey area may be covered in a shorter period of time, resulting in a lower overall survey cost. When a plurality of streamers are towed behind a single vessel, paravanes, being attached to the lead end of each streamer, are often used to laterally seperate the lead end of each streamer. One example of a paravane is described in U.S. Pat. No. 4,463,701 which issued Aug. 7, 1984 to Pickett, et al. A remotely controlled paravane is disclosed in U.S. Pat. No. 4,729,333 which issued Mar. 8, 1988 to Kirby, et al.

A particular difficulty has arisen when towing a plurality of streamers. In routine turns, all streamers normally tow in concentric circles. However during deployment or repair of the streamers or in non-routine turns such as slow speed turns or sharp turns, it is common for the streamers to cross and become tangled. It is possible to prevent entanglement of the streamers by diving one streamer while surfacing the other with the aid of the remotely controllable birds. Although this keeps the streamers from tangling, the tail buoys, which at all times remain on the water's surface, are likely to cross and become hooked, or the ropes that connect the buoys to the streamers may become tangled. Unhooking the tail buoys or untangling the ropes requires the use of a small auxiliary boat, if available. Otherwise, the streamers and ropes must be reeled toward the vessel to be untangled by the vessel operators.

Another difficulty arises when data is being collected near an offshore structure. As one or more streamers are towed behind a vessel, the wind and water current may cause the trailing end of the streamer to feather outwardly from the vessel's path. If data is being collected along a path near an offshore structure, the wind and current may push the streamer and tail buoy into the structure. As a result the buoy or the streamer may become damaged or they may become hooked to the structure.

Accordingly, in marine seismic exploration the need exists for a remotely controllable tail buoy which can be attached to a seismic streamer so as to indicate the approximate location of the trailing end of the streamer, and which can be remotely steered away from other tail buoys attached to other streamers or from offshore structures and other obstructions in order to prevent tangling of the tail buoys or damage to the tail buoys or streamers.

SUMMARY OF THE INVENTION

The present invention is a remotely controllable tail buoy that may be directed from a remote location such as from a towing vessel to prevent damage to the tail buoys, hooking of the tail buoys or tangling of the ropes when one or more streamers are being towed by the towing vessel. Additionally, the inventive tail buoy may be used when towing one or more streamers to direct the trailing ends of the streamers away from offshore structures or other obstructions which could damage the streamers.

In a preferred embodiment, the tail buoy is provided with two or more rudders, a steering mechanism and a communication system. The rudders are adapted to rotate substantially simultaneously about generally vertical axes to control the course of the tail buoy. The rotation of the rudders are controlled by the steering mechanism and the communication system. The steering mechanism controls the rudder position based on signals received by the communication system from a remote transmitter on the vessel. The communication system includes a two-way radio receiver tuned to the same frequency as the remote transmitter for receiving radio signals emitted from the remote transmitter. The signals are processed by a remote controller which is preferably a microprocessor-based controller and data acquisition system. The processed signals control the steering mechanism which includes a hydraulic pump. The pump directs flow to a hydraulic cylinder causing the rudders to turn. Then, as the vessel continues to move, the tail buoy will travel toward the direction that the rudders are turned thereby avoiding other tail buoys or offshore structures.

The tail buoy design preferably includes a single tubular float and an anti-roll weight. The tubular float provides all necessary buoyancy for the tail buoy while the anti-roll weight keeps the buoy in an upright or vertical position. This design lessens the probability that the tail buoys will hook if one buoy floats into another's path.

The steerable tail buoy of the present invention may include additional peripheral equipment such as rudder position sensors, relative positioning instrumentation and navigational instrumentation. The navigational instrumentation may be acoustic based, radio based or optical based instrumentation. Data from these sensors and instruments may be continuously transmitted to the vessel and fed into a computer located on board the vessel. The computer would continuously monitor the precise location of the tail buoy and initiate any necessary actions to adjust the course of the tail buoy.

DESCRIPTION OF THE DRAWINGS

The actual operation and advantages of the present invention will be better understood by referring to the following detailed description and the attached drawings in which.

While the invention will be described in connection with the preferred embodiments, it will be understood that the invention is not limited thereto. On the contrary, it is intended to cover all alternatives, modifications, and equivalents which may be included within the spirit and scope of the invention.

DESCRIPTION OF THE PREFERRED EMBODIMENT

Figure 1:
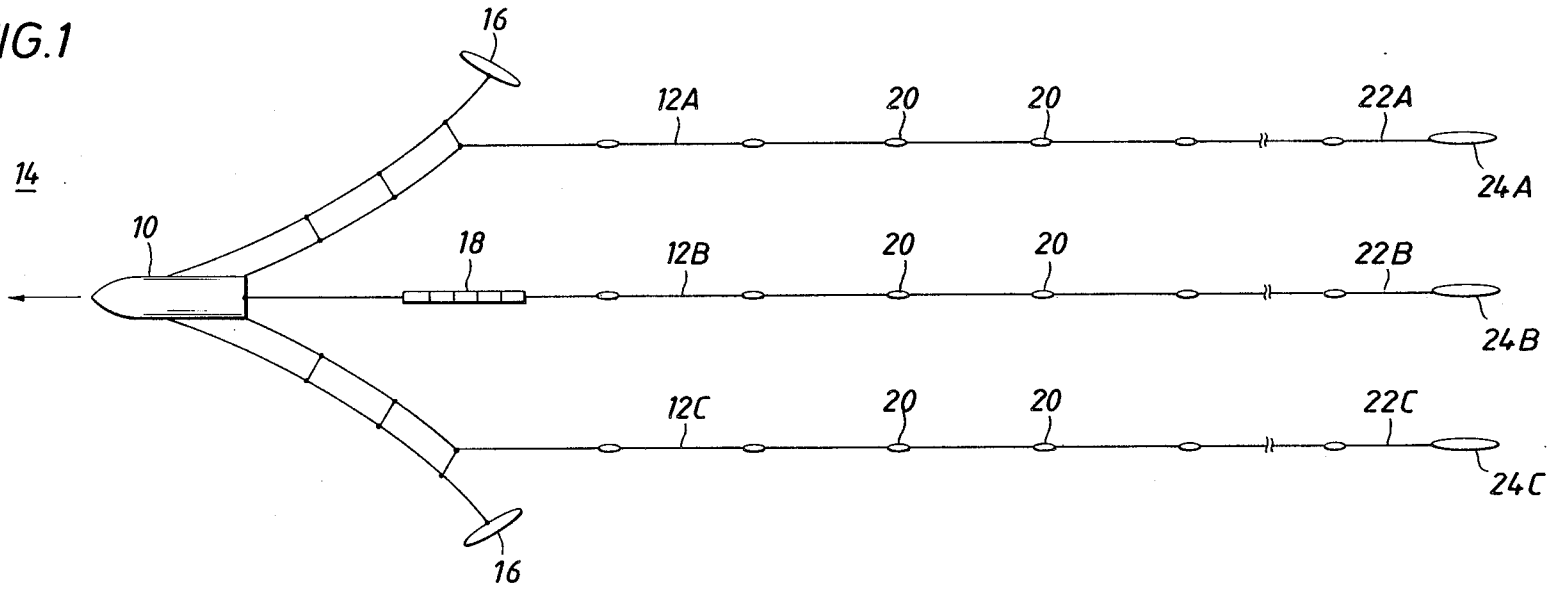
FIG. 1 is a plan view of a vessel towing three streamers with the inventive tail buoys attached to ends of the streamers.

FIG. 1 illustrates a plan view of vessel 10 which is moving in the direction of the arrow and is towing three streamers 12A, 12B, and 12C in a body of water 14. In normal operation, streamers 12A, 12B, and 12C are towed at a constant depth of approximately 3 to 15 meters (10–50 feet) below the surface of water 14. Outer streamers 12A and 12C are maintained separated laterally from streamer 12B by paravanes 16. The total distance between streamers 12A, 12B, and 12C can be varied from approximately 50–300 meters (160–1000 feet). For illustration purposes only, seismic source 18 is shown directly behind vessel 10. The most common seismic source used today is an air gun array. Other seismic sources include water guns, explosive gas guns, steam, small explosives and marine vibrators. Spaced along the length of each streamer 12A, 12B, and 12C are remotely controllable birds 20. Birds 20 are typically used to control the depth of streamers 12A, 12B, and 12C. However, as illustrated in U.S. Pat. No. 3,605,675 to Weese, birds 20 also have been designed to control, although to a limited extent, lateral movement of streamers 12A, 12B, and 12C. At the far end of streamers 12A, 12B, and 12C, attached by ropes 22A, 22B, and 22C, are the inventive tail buoys 24A, 24B, and 24C disclosed herein. Tail buoys 24A, 24B, and 24C are used to indicate the approximate location of the ends of streamers 12A, 12B, and 12C and warn boat operators and others that one or more streamers are being towed.

Figure 2:
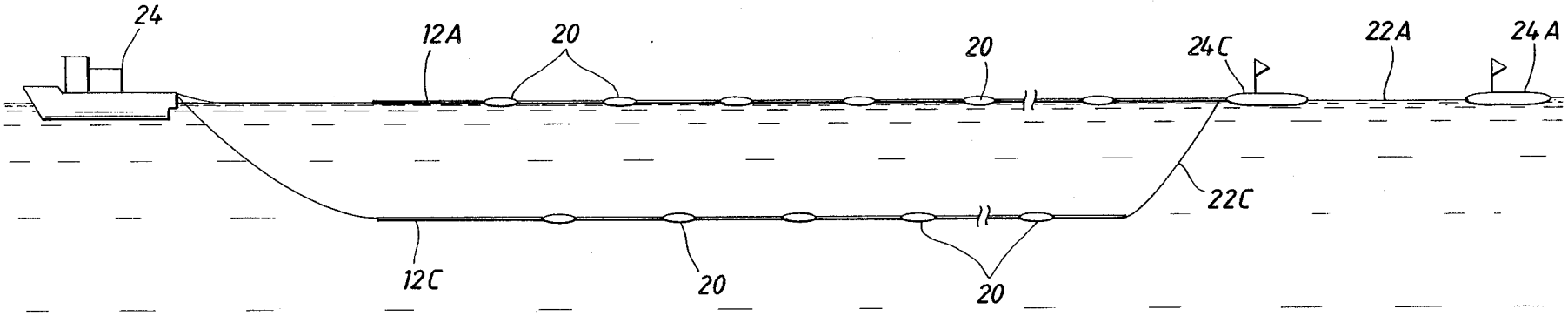
FIG. 2 is a side view of a vessel towing two streamers, illustrating that one streamer has been lowered to avoid entanglement with the other streamer during a repair operation and the other streamer has been raised to the surface of the water.

FIG. 2 illustrates the particular problem to be solved by steerable tail buoy 24 of the present invention. For purposes of simplification, streamer 12B and seismic source 18 are not included in FIG. 2. During a repair operation using an auxiliary boat (not shown), to avoid tangling of streamers 12A and 12C, streamer 12A is raised to or near the surface of water 14 and streamer 12C is lowered by about 18 to 30 meters (60–100 feet) by birds 20. As the repairs are being made, streamers 12A and 12C may cross paths due to wind or surface currents but they will not tangle due to vertical separation. However, since tail buoys 24A and 24C remain on the surface of water, they may hit one another, become hooked, or ropes 22A and 22C may tangle.

Figure 3:
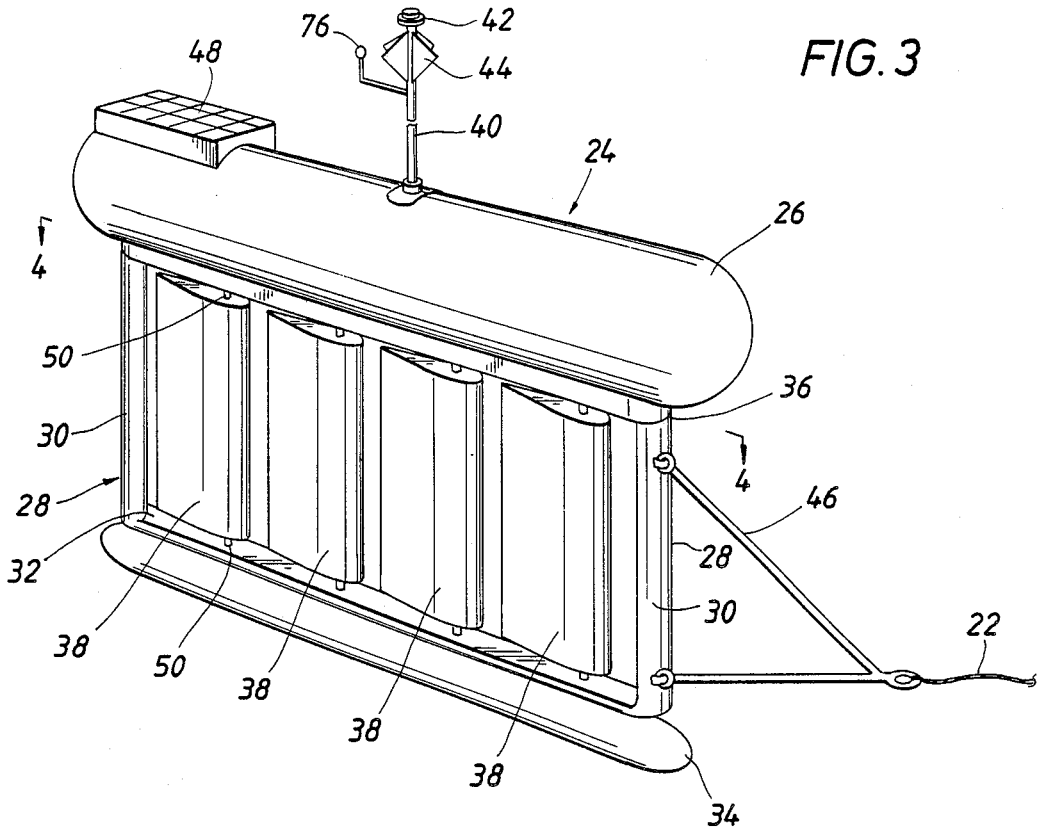
FIG. 3 is a perspective view of the inventive tail buoy.

FIG. 3 illustrates a perspective view of a preferred embodiment of steerable tail buoy 24. The major components shown include tubular float 26, frame 28, anti-roll weight 34, actuator housing 36, rudders 38, mast 40 with light 42 and radar reflector 44, tow bridle 46 and solar panel 48, if desired. Float 26 provides sufficient buoyancy to maintain tail buoy 24 on the surface of body of water 14 during operation. Preferably the buoyancy is provided by one tubular float 26, rather than a plurality of floats in order to reduce the possibility of one tail buoy getting hooked to another by reducing the number of components on the tail buoy. Float 26 should be designed to provide low drag when towed while maintaining adequate hydrodynamic stability. Many designs are feasible, however a cylindrical float with hemispherical ends may be preferred. Frame 28 is attached to the bottom of float 26 by one or more support legs 30. Support legs 30 extend downwardly from float 26 and attach to base plate 32. Attached to base plate 32 is anti-roll weight 34 which reduces rolling of tail buoy 24 due to rudder lift or sea state. Anti-roll weight 34 can be a lead pipe or any other object of sufficient weight to reduce rolling of tail buoy 24. The weight tends to lower the center of gravity, reducing rolling in a manner similar to ballast in a ship's keel. If a plurality of floats are used, anti-roll weight 34 may not be needed. Actuator housing 36, being attached to the bottom of float 26, contains the tail buoy steering mechanism and communication system which will be further described in connection with FIG. 4. Rudders 38 are substantially vertical, wing-shaped plates of either uniform or varied size and shape. Although any number of rudders may be used, a preferred embodiment has at least two rudders to allow tail buoy 24 to move laterally while continuing to face the general towing direction of vessel 10. Rudders 38 are connected to tail buoy 24 by rudder shafts 50. In a preferred embodiment rudder shafts 50 extend vertically through rudders 38 and upwardly into actuator housing 36, where they are fixedly attached to tiller arms 52 (see FIG. 4). In a preferred embodiment, the lower end of rudders shafts 50 are rotatably attached to base plate 32 of frame 28 for added strength to prevent shafts 50 from twisting or bending. Rudders 38 are fixed to rudder shafts 50 so that rotation of the rudder shafts 50 will rotate the rudders 38. Alternatively, rudder shafts 50 and rudders 38 may be integrated into single components, each component forming one shaft 50 and one rudder 38. The angular position of rudders 38 is controlled by the steering mechanism (see FIG. 4) which is in actuator housing 36. Connected to mast 40 is light 42, radar reflector 44 and radio antenna 76. Light 42 aids in visual detection of tail buoy 24; radar reflector 44 aids in radar detection of tail buoy 24; and radio antenna 76 (further described with FIG. 4) receives and transmits signals from vessel 10 or from another remote location. Tow bridle 46 is the connection on which to tie rope 22. In a preferred embodiment as illustrated in FIG. 3, one end of tow bridle 46 is attached to frame 28 near actuator housing 36 and the other end is attached near anti-roll weight 29. This connection will provide towing stability particularly when tail buoy 24 is provided with a single tubular float 26. Tow bridle 46 may be made of any suitable shape and material, including flexible material such as a rope or chain, having sufficient strength to tow buoy 24 without breaking. Solar panel 48 is an optional device intended to supplement battery 78 (see FIG. 4) through the utilization of solar energy. The output of solar panel 48 is related to available sunlight and therefore is dependent on the time of day and weather. Marine worthy solar panels are commercially well known and will not be further described.

Figure 4:
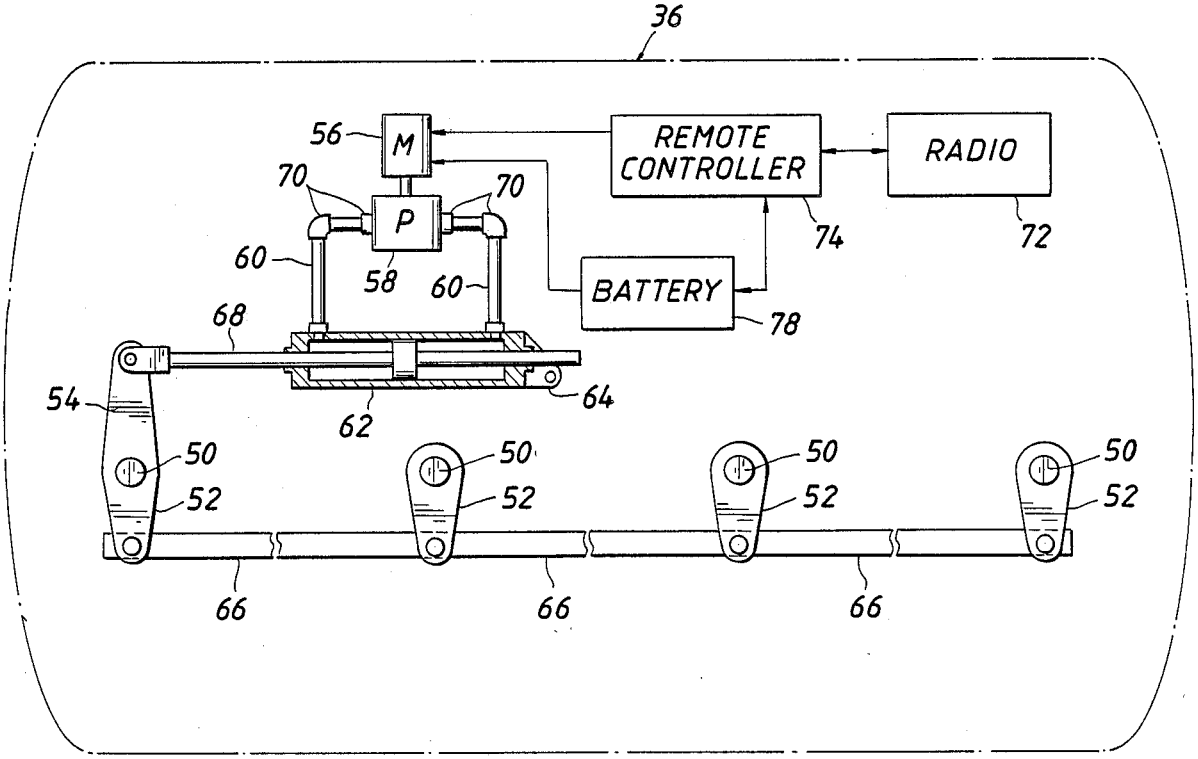
FIG. 4 is an internal diagram along line 4—4 of FIG. 3 which illustrates a preferred embodiment of the tail buoy's steering mechanism, communication system and power source.

Actuator housing 36 is sealed against water penetration. Within actuator housing 36 is the steering mechanism for turning rudders 38, the communication system which provides a communication link between operators on vessel 10 and tail buoy 24, and battery 78 which supplies the necessary power to run the communication system and the steering mechanism. FIG. 4 illustrates a preferred embodiment of the elements within actuator housing 36.

Referring to FIG. 4, the steering mechanism in a preferred embodiment includes tiller arms 52, connecting rod 66, hydraulic cylinder 62 with piston rod 68, hydraulic pump 58 with flexible fluid conduits 60, and motor 56. FIG. 4 illustrates four tiller arms for purposes of illustration; however, it will be understood that there is one tiller arm for each rudder 38. Tiller arms 52 are generally elongated and are connected to rudder shafts 50. Opposite the connection to rudder shafts 50, tiller arms 52 are pivotally attached to connecting rod 66 in series. As connecting rod 66 moves, tiller arms 52 will simultaneously rotate rudder shafts 50, thereby causing rudders 38 to rotate simultaneously.

Connecting rod 66 may be moved in a number of ways. In a preferred embodiment, as illustrated in FIG. 4, hydraulics are used. Receiving electrical power from battery 78, motor 56 powers hydraulic pump 58. Hydraulic pump 58 directs hydraulic fluid (not shown) through one of the fluid conduits 60 into hydraulic cylinder 62 which is pivotally mounted on one end 64 to actuator housing 36. The pressure of the hydraulic fluid in cylinder 62 causes piston rod 68 to move. Piston rod 68 is pivotally attached to extension 54 on one of the tiller arms 52 opposite the connection to connecting rod 66. As piston rod 68 moves, it causes tiller arm 52 to rotate about the axis of rudder shaft 50 and move connecting rod 66. This results in simultaneous rotation of rudder shafts 50 and rudders 38. Fluid conduits 60 are constructed using a flexible material or joints 70.

Motor 56 is preferably a low voltage (12 volt for example) reversible DC motor. Battery 78 may be supplemented or recharged by solar panel 48 (see FIG. 3). Pump 58 may be a bidirectional pump which works in combination with an internally piloted, double check valve (not shown). Pump 58 is capable of pumping the hydraulic fluid into either side of hydraulic cylinder 62 through fluid conduits 60. The double check valve hydraulically locks rudders 38 into place when pump 58 is turned off. When pump 58 is turned on, cracking pressures of the check valve are overcome allowing fluid to flow, thereby affecting rotation of rudders 38. As an alternative, pump 58 may be a non-reversable pump where hydraulic fluid flow may be directed into either side of hydraulic cylinder 62 by using a solenoid-operated, normally closed, 4-way, 3-position control valve (not shown). As a second alternative, rotation of rudders 38 could be achieved by using an electromechanical push-pull actuator (not shown). If used, the electric actuator would replace hydraulic cylinder 62, the control valve (if used), and pump 58. However, due to low mechanical efficiency, the electric push-pull actuator will result in high power consumption. Other methods for actuating the rudders will be apparent to those skilled in the art.

The tail buoy communication system includes radio 72, remote controller 74 and antenna 76 (see FIG. 3). In a preferred embodiment radio 72 is a two-way radio capable of sending and receiving signals transmitted through antenna 76 over radio waves. Remote controller 74 is a microprocessor-based controller and data acquisition system, such as Motorola's microprocessor, Model 6805. It decodes and executes commands transmitted to radio 72 over radio waves from a two-way radio (not shown) by a master controller (not shown), each being on vessel 10. In addition, remote controller 74 regulates the average charge rate of battery 78 by automatically switching solar panel 48 (see FIG. 3) on or off as needed. Typically the communication system is contained within actuator housing 36, however antenna 76 may extend outside actuator housing 36 (see FIG. 3) for improved reception.

The communication equipment (not shown) on vessel 10 includes a two-way radio, an antenna, a master controller, a CRT screen and a power source. The two-way radio on vessel 10 is preferably capable of transmitting and receiving signals through the vessel antenna to and from radio 72 on tail buoy 24. The signals received by the vessel radio on vessel 10 are input to the master controller which analyzes the signals received and displays the status of tail buoy 24 on the CRT screen. In a preferred embodiment, the master controller is a portable personal computer.

To summarize, if the vessel operator determines that the location of tail buoy 24 relative to other buoys or offshore structures is not acceptable, the vessel operator initiates a rudder change command by requesting a new rudder setting through signals transmitted from the vessel radio to radio 72 on tail buoy 24. When a rudder change command is received by radio 72, such commands are electronically input to remote controller 74. Remote controller 74 executes the command by turning on motor 56. Motor 56 supplies operating power to hydraulic pump 58. Pump 58 directs hydraulic fluid into hydraulic cylinder 62 causing piston rod 68 to move, thereby moving rod 66 from side to side. Such movement causes tiller arms 52 to turn rudders 38. Changing the direction of rudders 38 will cause tail buoy 24 to move in a new direction, thereby changing the location of tail buoy 24 relative to other tail buoys or offshore structures. A feed-back system (not shown) capable of reading the rudder position, measured in degrees, provides rudder position data to remote controller 74 which turns motor 56 off after the new rudder setting is reached. Remote controller 74 confirms that all rudder changes are executed by signaling back through radio 72 and the vessel radio to the master controller a confirmation after the change is complete. In addition, remote controller 74 may periodically update the vessel operators through the master controller and the CRT screen on the following data regarding tail buoy 24: rudder position, battery voltage, battery current, solar panel voltage, solar panel current, motor current, electronic reference voltage, sea water intrusion, and hydraulic line pressures from pressure transducers (not shown).

The present invention and the best modes contemplated for practicing the invention have been described. It should be understood that the invention is not to be unduly limited to the foregoing which has been set forth for illustrative purposes. Various modifications and alternatives of the invention will be apparent to those skilled in the art without departing from the true scope of the invention. Accordingly, the invention is to be limited only by the scope of the appended claims.

What I claim is:

1. A remotely controllable tail buoy for use in marine towing operations, said tail buoy being attached to an object being towed by a vessel in a body of water so as to indicate the approximate location of said object, said tail buoy comprising:

a buoyant float;

at least two substantially vertical and substantially parallel rudders each rotatably attached by a shaft to said buoyant float and extending generally downwardly into said body of water;

a communication system adapted to receive and decode signals transmitted from said vessel; and a steering mechanism being electrically attached to said communication system and operatively attached to said shafts so that said steering mechanism will respond to said signals that are received and decoded by said communication system by simultaneously rotating said shafts, thereby shifting the angular orientation of said rudders relative to the course of said vessel causing said tail buoy to change directions.

2. The tail buoy of claim 1 further comprising an anti-roll weight attached to said buoyant float and generally positioned below said buoyant float in said body of water, said anti-roll weight having sufficient weight to reduce rolling of said buoy.

3. The tail buoy of claim 1 further comprising a power source capable of providing sufficient electrical power to operate said communication system and said steering mechanism, said power source being electrically connected to said communication system and said steering mechanism.

4. The tail buoy of claim 1 wherein said steering mechanism shifts said angular orientation of said rudders hydraulically.

5. A remotely controllable tail buoy for use in marine towing operations to indicate the approximate location of an object being towed in a body of water by a vessel having a vessel communication system, said tail buoy being attached to said object by a rope, said tail buoy comprising:

a buoyant float;

at least two substantially vertical and substantially parallel rudders each rotatably attached by a shaft to said buoyant float and extending generally downwardly into said body of water in such a manner that said rudders will control the course of said tail buoy, said rudders being adapted to be simultaneously rotatable about said shafts;

a buoy communication system capable of receiving and decoding signals transmitted from said vessel communication system;

a steering mechanism being electrically attached to said buoy communication system and operatively attached to said shafts so that said steering mechanism will respond to said signals received and decoded from said vessel communication system by simultaneously rotating said shafts, thereby shifting the angular orientation of said rudders relative to the course of said vessel causing said tail buoy to change directions; and a power source capable of providing sufficient electrical power to operate said communication system and said steering mechanism, said power source being electrically connected to said communication system and said steering mechanism.

6. The tail buoy of claim 5 wherein said steering mechanism controls said rotation of said rudders hydraulically.

7. The tail buoy of claim 5 wherein said power source comprises a battery.

8. The tail buoy of claim 7 wherein said power source further comprises a solar panel mounted on the upper surface of said buoyant float and adapted to supplement the electrical power provided by said battery.

9. The tail buoy of claim 5 wherein said buoy communication system comprises:

a radio receiver adapted to receive signals over radio waves transmitted from said vessel communication system; and a microprocessor-based controller electrically attached to said radio receiver, said microprocessor-based controller being capable of decoding said signals received by said radio receiver into commands and causing said commands to be executed by said steering mechanism to control and adjust the angular position of said rudders.

10. The tail buoy of claim 5 further comprising an anti-roll weight attached to said buoyant float and generally positioned below said buoyant float in said body of water, said anti-roll weight having sufficient weight to reduce rolling of said buoyant buoy.

11. A remotely controllable tail buoy for use in marine towing operations, said tail buoy being attached by a rope to an object being towed by a vessel in a body of water so as to indicate the approximate location of said object, said tail buoy comprising:

a singular buoyant float having a bottom side;

an actuator housing sealed against water penetration and attached to said bottom side of said singular float;

a communication system located within said actuator housing for receiving and decoding radio signals transmitted from a remote location, said communication system comprising a radio receiver and a microprocessor-based controller;

a steering mechanism located within said actuator housing and being operatively attached to said communication system so that operation of said steering mechanism is controlled and directed by said communication system in response to said decoded radio signals;

a plurality of rudders for directing said course of said tail buoy, said rudders being attached to shafts, said shafts extending generally downwardly from said actuator housing into said water, said shafts being rotatably attached to said steering mechanism so that said steering mechanism is capable of simultaneously controlling said rotation of said shafts thereby simultaneously controlling the rotation of said rudders;

a power source capable of providing sufficient electrical power to operate said communication system and said steering mechanism, said power source being electrically connected to said communication system and said steering mechanism; and an anti-roll weight attached to said bottom of said singular buoyant float and having sufficient weight to reduce rolling of said tail buoy.

12. The remotely controllable tail buoy of claim 11 wherein said steering mechanism controls said plurality of rudders hydraulically.

13. The remotely controllable tail buoy of claim 11 wherein said plurality of rudders and said shafts are integrated into single components, each component forming one shaft and one rudder.

14. The remotely controllable tail buoy of claim 11 wherein said power source comprises a battery.

15. The remotely controllable tail buoy of claim 14 wherein said power source further comprises a solar panel mounted on the upper surface of said buoyant float and adapted to supplement the electrical power provided by said battery.

* * * * *